US005173635A

United States Patent [19]

Kane

[11] Patent Number: 5,173,635

[45] Date of Patent: Dec. 22, 1992

[54] BI-DIRECTIONAL FIELD EMISSION DEVICE

[75] Inventor: Robert C. Kane, Woodstock, Ill.

[73] Assignee: Motorola, Inc., Schaumburg, Ill.

[21] Appl. No.: 621,186

[22] Filed: Nov. 30, 1990

[51] Int. Cl.[5] ..... H01J 1/30

[52] U.S. Cl. ..... 313/309; 313/306; 313/336; 313/351; 315/58

[58] Field of Search ..... 313/306, 309, 310, 336, 313/351; 315/169.1, 169.3, 58

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 445/52 |
| 3,810,025 | 5/1974 | Aihara et al. | 313/336 X |
| 3,812,559 | 5/1974 | Spindt et al. | 445/52 |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,904,895 | 2/1990 | Tsukamoto et al. | 313/336 |
| 4,990,766 | 2/1991 | Simms et al. | 313/338 X |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vaccum Field Effect Transistor Using Silicon Field Emitter Arrays, by Gray, 1986 IEDM.

Advanced Technology: flat cold-cathode CRTs, by Ivor Brodie, Information Display Jan. 1989.

Field-Emitter Arrays Applied to Vacuum Flourescent Display, by Spindt et al. Jan., 1989 issue of IEEE Transactions on Electronic Devices.

Field Emission Cathode Array Development for High--Current Density Applications by Spindt et al., dated Aug. 1982 vol. 16 of Applications of Surface Science.

*Primary Examiner*—Donald J. Yusko
*Assistant Examiner*—Ashok Patel
*Attorney, Agent, or Firm*—Eugene A. Parsons

[57] ABSTRACT

A field emission device is set forth for providing selected bi-directional transport of charge carriers.

8 Claims, 4 Drawing Sheets

-PRIOR ART-

BI-DIRECTIONAL FIELD EMISSION DEVICE

FIELD OF THE INVENTION

This invention relates generally to cold-cathode field emission devices.

BACKGROUND OF THE INVENTION

Cold-cathode field emission devices (FEDs) are known in the art. These FEDs are commonly configured as multielectrode structures, such as diodes, triodes, tetrodes, etc. A number of desirable features of FEDs include vacuum transport of charge carriers, sizes on the order of microns, and high voltage compatibility. An additional feature of FEDs is that electron emission is uni-directional, flowing primarily from the emitter(s). However, known configurations of FEDs do not provide a convenient method of interconnecting separate FEDs to realize reciprocal current flow and simultaneously maintain an integrated device structure.

As such, prior art FEDs do not provide a mechanism wherein charge carriers may flow reciprocally within a single integral device.

Accordingly, there exists a need for an improved FED which provides for reciprocal flow of charge carriers.

SUMMARY OF THE INVENTION

This need and others are substantially met through provision of a bi-directional field emission device in accordance with the present invention. The bi-directional field emission device in accordance with the present invention comprises: an anode/emitter electrode and an emitter/anode electrode, selectively distally disposed with respect to each other and geometrically formed such that each anode/emitter and emitter-/anode electrode electrode may function as an emitter electrode for emitting electrons, and, further, each may function as an anode electrode for collecting at least some of the electrons emitted by an emitter electrode, wherein application of selected voltages to each of the anode/emitter electrode and emitter/anode electrode determines the mode in which each anode-emitter electrode and emitter/anode electrode functions; and a first gate extraction electrode, electrically coupled to the one of the anode/emitter and emitter/anode electrode electrode functioning as an emitter electrode and to the one of the anode/emitter and the emitter/anode electrode electrode functioning as an anode electrode, the gate extraction electrode being proximally disposed in the intervening region between the and emitter/anode anode/emitter electrodes; such that reciprocal electron flow is selectably achieved within that device.

DETAILED DESCRIPTION OF A PREFERRED EMBODIMENT

Figure 1:
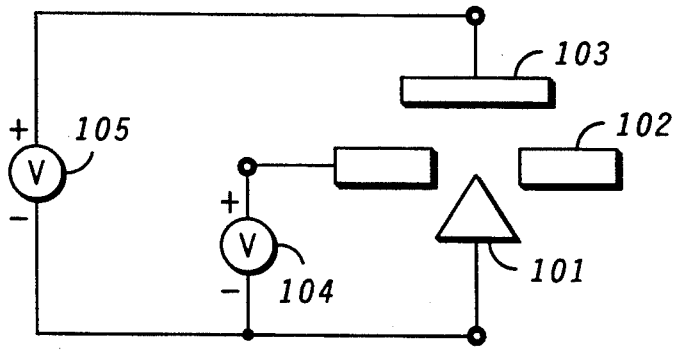
FIG. 1 is a schematic drawing of a conventional FED triode of the prior art.

In a conventional field emission device (FED) of the prior art, typically a triode, as depicted in FIG. 1, a selected potential difference may typically be realized by applying a voltage of appropriate polarity and magnitude to either a gate extraction electrode (102), the emitter electorde (101), or both. Useful device operation is generally achieved by applying a selected voltage (105) having a magnitude and polarity such that at least some of the electrons emitted by the emitter electrode (101) are substantially collected by the anode electrode (103). Modulation of the potential difference (104) between the gate extraction electrode (102) and the emitter electrode (101) will correspondingly modulate electron emission rate to yield a functional transconductance device.

Figure 2:
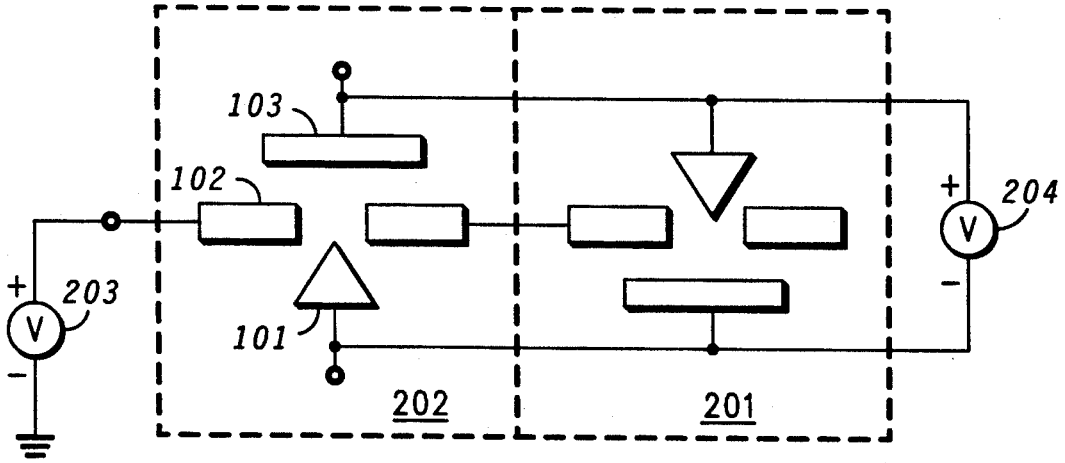
FIG. 2 is a schematic drawing of two interconnected conventional FED triodes of the FIG. 1 prior art.

Referring now to FIG. 2, a schematic drawing of two interconnected conventional FED triodes of the FIG. 1 prior art, there are depicted at least a first and at least a second FED (201, 202). Each conventional FED (201, 202) is comprised of an emitter electrode (101), a gate extraction electrode (102), and an anode electrode (103). Further, the anode electrode (103) of the first FED (201) is operably coupled, typically electrically, to the emitter electrode (101) of the second FED (202). Correspondingly, the anode electrode (103) of the second FED (202) is operably coupled to the emitter electrode (101) of the first FED (201). Also, gate extraction electrodes (102) of both the first and second FEDs (201, 202) are operably coupled, typically electrically, to each other. A first applied potential (203) is typically applied to the gate extraction electrode, and a desired potential difference (204) is established between the emitter electrode (101) and the anode electrode (103).

Figure 3:
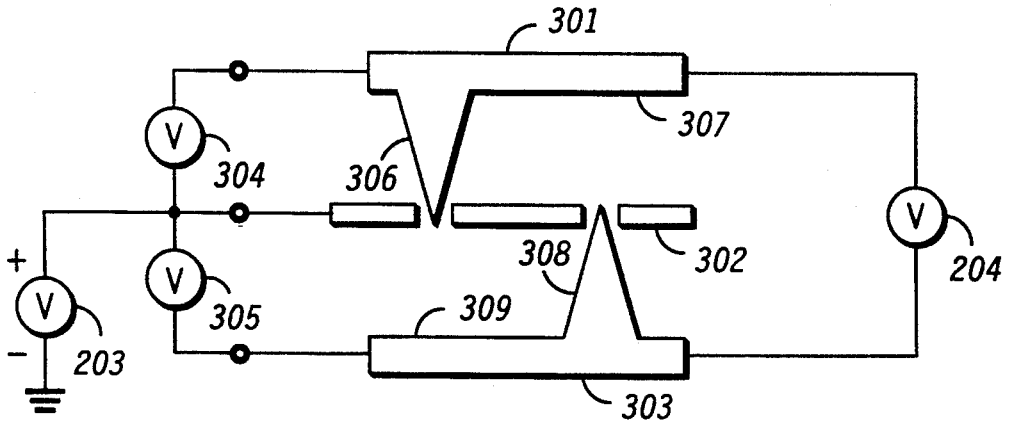
FIG. 3 is a top plan view of a first embodiment of a bi-directional FED constructed in accordance with the present invention.

FIG. 3 depicts a top plan view of a first embodiment of a bi-directional FED constructed in accordance with the invention. For the device shown, an anode/emitter electrode (301) is shown with a region that includes a geometric discontinuity (306) of small radius of curvature and a region that is substantially geometrically continuous (307). An emitter/anode electrode (303) is similarly configured and distally disposed such that the substantially geometrically continuous region (309) of the emitter/anode electrode (303) will, when properly biased, collect a substantial portion of any electrons emitted from the region of geometric discontinuity (306) associated with the anode/emitter electrode (301). Also, as configured and disposed and when properly biased, the substantially geometrically continuous region (307) of the anode/emitter electrode (301) will collect a substantial portion of any electrons emitted from the region of geometric discontinuity (308) associated with the emitter/anode electrode (303). Electron emission rate is determined by the magnitude and polarity of the first applied potential (203) which may be applied to a gate extraction electrode (302) or by applying voltages of appropriate magnitude and polarity to both/either the anode/emitter electrode (301) and/or the emitter/anode electrode (303) to result in suitable potential differences (304, 305) between the gate extraction electrode (302) and the anode/emitter electrode (301), and the gate extraction electrode (302) and the emitter/anode electrode (303) respectively. These suitable potential differences (304, 305) may be equivalently described as a single desired potential difference (204) between the anode/emitter electrode (301) and the emitter/anode electrode (303). The polarity of a potential which exists between the anode/emitter electrode (301) and the emitter/anode electrode (303), in concert with the first applied potential (203) provided to the gate extraction electrode (302) will determine which of the anode/emitter electrode (301) and the emitter-/anode electrode (303) will function as an anode and which will function as an emitter. For example, if potential sources are provided to the various electrodes of the bi-directional field emission device such that the anode/emitter electrode (301) is at a less positive potential than the emitter/anode electrode (303) and providing that the first applied potential (203), selected to be suitable for extraction, is provided to the gate extraction electrode (302) (shown as three line segments proximally disposed about the regions of geometric discontinuity (306, 308) such that the potential (203) induces an enhanced electric field at the region of geometric discontinuity (306) of sufficient magnitude to establish electron emission from an emission site substantially disposed on the surface of the anode/emitter electrode (301) proximal to the region of greatest enhancement of the electric field substantially at the region of the geometric discontinuity (306) and, further providing that the first applied potential (203) is less positive than a potential existing at the emitter/anode electrode (303), the anode/emitter electrode (301) will function as an emitter electrode and the emitter/anode electrode (303) will function as an anode electrode.

Alternatively, establishing a potential at the anode/emitter electrode (301) more positive, substantially, than any potential which may be applied at the emitter-/anode electrode (303) while providing the first applied potential (203) of a suitable magnitude for extraction to the gate extraction electrode (302) such that an enhanced electric field of sufficient magnitude to establish electron emission from an emission site substantially disposed on the surface of the emitter/anode (303) proximal to a region of greatest enhancement of the electric field, substantially at the region of the geometric discontinuity (308) will result in the anode/emitter electrode (301) and the emitter/anode electrode (303) functioning as an anode electrode and an emitter electrode, respectively.

Where desired, the gate extraction electrode (302) may be provided a potential which is sufficiently positive with respect to either or both of the anode/emitter electrode (301) and the emitter/anode electrode (303) such that an appreciable portion of any emitted electrons are collected at the gate extraction electrode (302). A circumstance wherein a substantial portion of any emitted electrons of an FED are collected at a gate extraction electrode may conveniently be termed as a reverse-biased mode, in contrast to an off-mode, which exhibits substantially no electron emission.

Figure 4:
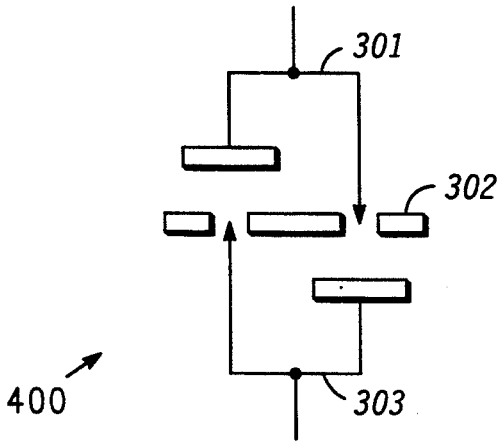
FIG. 4 is a schematic drawing of the first embodiment of a bi-directional FED according to the present invention.

FIG. 4 depicts schematically the first embodiment of a bi-directional FED (400) as described above with reference to FIG. 3.

Figure 5:
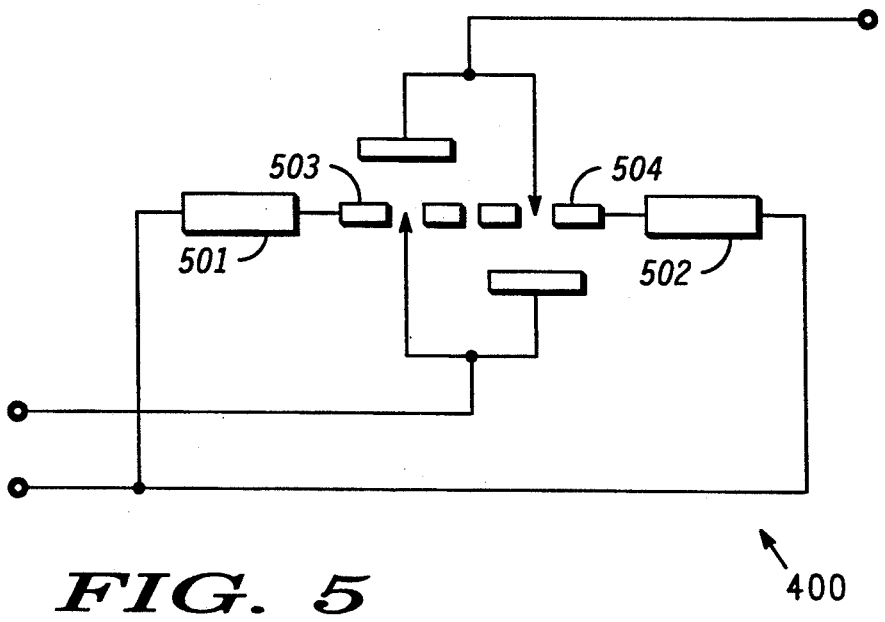
FIG. 5 is a schematic drawing of a second embodiment of a bi-directional FED according to the present invention.

FIG. 5 depicts schematically a second embodiment of a bi-directional FED (400) wherein at least a first impedance element (501,502, . . . ) for modulating a rate of electron emission from the emitter electrode is operably coupled, typically electrically, to at least a first gate extraction electrode (503, 504, . . . ). The bi-directional FED (400) is shown with a first and a second gate extraction electrode (503, 504) operably coupled to a first and a second impedance element (501, 502), respectively. So configured, electron current which may be collected at an associated gate extraction electrode (503, 504) of a reverse-biased segment of a bi-directional FED (400) will cause a corresponding reduction in the gate potential for that segment of the FED (400). This will result in stabilization of electron emission, at the reverse biased segment of the bi-directional FED (400), to a lower level than would be the case without the current limiting impedance element(s) (501, 502).

Figure 6:
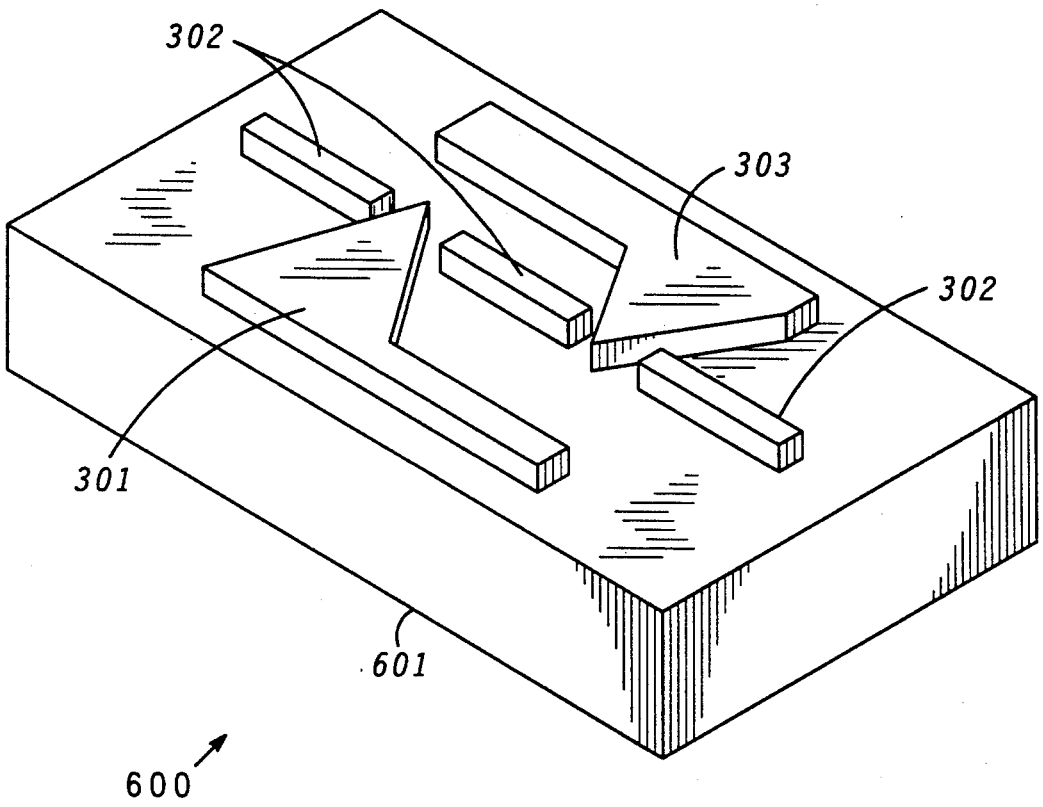
FIG. 6 is a perspective view of the first embodiment of a bi-directional FED in accordance with the present invention.

FIG. 6 is a perspective view of the third embodiment of a bi-directional FED (600) substantially as described above with reference to FIG. 3. An FED is illustrated as a planar device comprised of a first anode/emitter electrode (301), a second anode/emitter electrode (302), and a gate extraction electrode (302) comprised of a plurality of segments, each of which segments is operably electrically coupled to the other segments, wherein all of said electrodes are substantially disposed on a surface of a substrate (601). So configured, the plurality of segments of the gate extraction electrode (302) being operably coupled together, typically electrically, and with appropriate voltages and potentials provided as described above, the FED (600) will function as a bi-directional FED.

Figure 7:
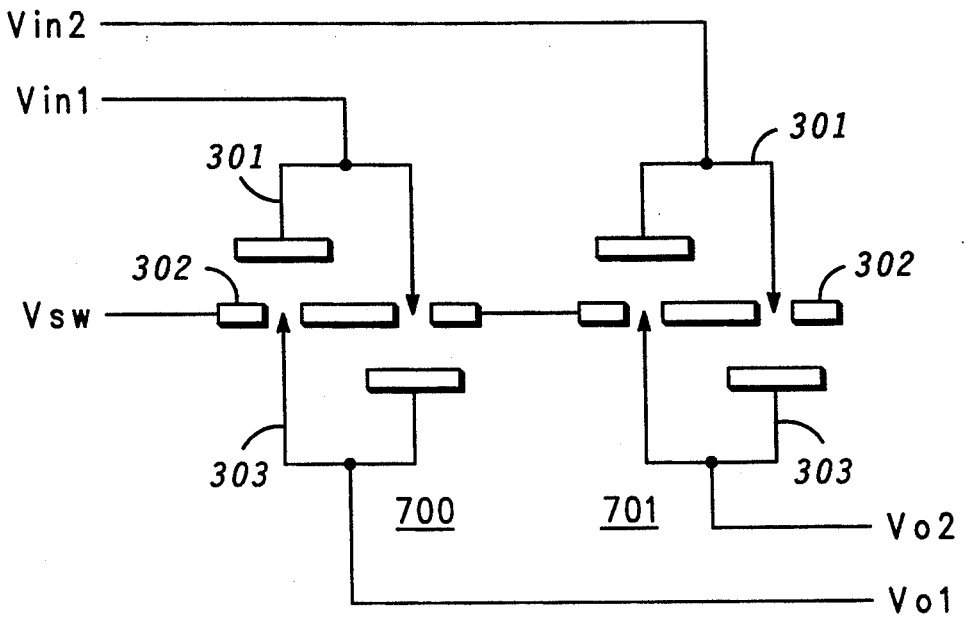
FIG. 7 is a schematic drawing of a third embodiment of at least two interconnected bi-directional FEDs in accordance with the present invention.

Referring now to FIG. 7, a schematic representation of a first embodiment of an electronic device employing at least two bi-directional FEDs (700, 701) is shown in accordance with the present invention. Independent input voltages may be applied to anode/emitter electrodes (301) of each of the at least first and second bi-directional FEDs (700, 701). Independent output voltages are designated at the emitter/anode electrodes (303) of each of the at least first and second bi-directional FEDs (700,701). Output voltages will be realized, and will substantially correspond to input voltages of the respective FED (700, 701) whenever an indicated switching voltage, Vsw, is applied to the gate extraction electrodes (302). The at least two bi-directional FEDs (700, 701), intercoupled electrically as shown, may be extended to any multiplicity of bi-directional FEDs so that independent input voltages, made available to each of the bi-directional FEDs, may all be realized at their respective outputs by application of a single voltage to all of the gate extraction electrodes.

Figure 8:
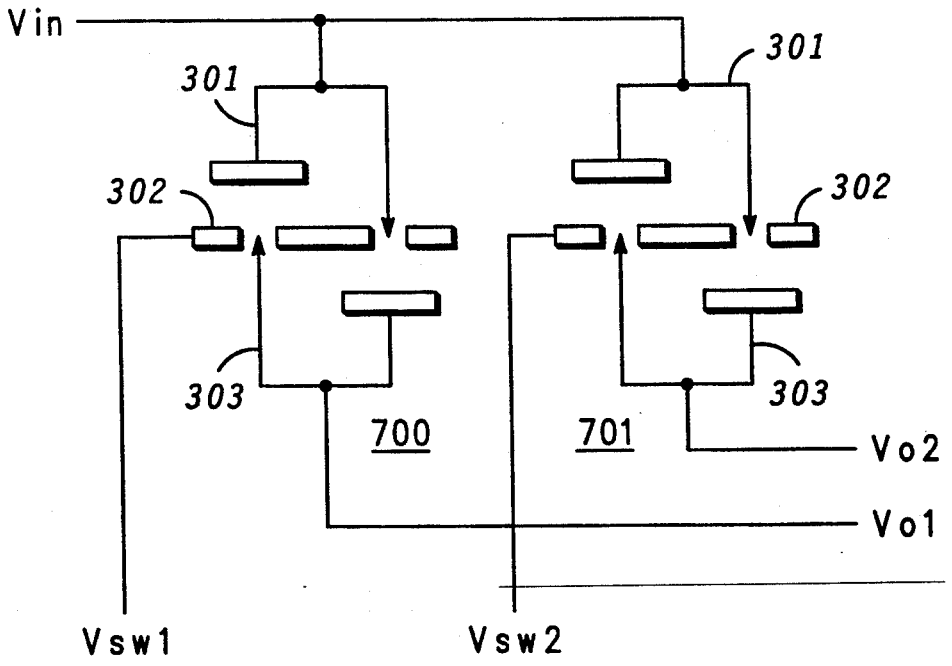
FIG. 8 is a schematic drawing of a fourth embodiment of at least two interconnected bi-directional FEDs in accordance with the present invention.

Referring now to FIG. 8, a schematic representation of a second embodiment of an electronic device employing at least two bi-directional FEDs is shown. A single input voltage, Vin, is shown applied to the anode/emitter electrodes (301) of each of the first and second bi-directional FEDs (700, 701). Independent output voltages are designated at emitter/anode electrodes (303) of each of the first and second bi-directional FEDs (700, 701). Output voltages will be realized and will substantially correspond to input voltages of the respective FED whenever indicated independent switching voltages are independently applied to each of the gate extraction electrodes (302). The at least two bi-directional FEDs, intercoupled as shown, may be extended to any multiplicity of bi-directional FEDs so that an input voltage, made available simultaneously to each of the at least two bi-directional FEDs, may be selectively independently realized at each of the respective outputs by application of an independent switching voltage to each of the gate extraction electrodes.

Clearly, uni-directional FEDs may be incorporated into a multiplicity of bi-directional FEDs where the uni-directional FEDs are operably coupled to be utilized in a uni-directional manner only.

Pursuant to this invention, an FED is constructed comprising at least two electrodes each of which may function alternatively as the device anode or emitter and also including at least one electron emission controlling gate electrode. In any instance when at least a first of the at least two anode/emitter electrodes functions as an anode, the applied voltages will result in at least a second of the at least two anode/emitter electrodes functioning as the device electron emitter. So constructed, the FED of the present invention provides for an integrable, active, vacuum electron transport device achieving reciprocal flow of charge carriers.

Bi-directional FEDs provide a flexibility in charge carrier transport that may be incorporated into larger electrical devices such as radios, computers, and the like, and provide an integrable circuit function not previously available.

I claim:

1. A bi-directional field emission device comprising:

A) a supporting substrate;

B) a first electrode and a second electrode, each comprising a first portion having an electron emitting tip and a second portion having a planar configuration, said first and second portions of said each of said first and second electrodes being geometrically continuously formed, said first and second electrodes selectively disposed with respect to each other on the supporting substrate, such that, the first portion of one of the first and second electrodes confronts the second portion of the other of the first and second electrodes and vice a versa, such that, in a first operating mode, said one of the first and second electrodes functions as an emitter electrode for emitting electrons from the first portion and at the same time, said other of the first and second electrodes functions as an anode electrode for collecting, at the second portion, at least some of the electrons emitted by the one of the first and second electrodes, and in a second operating mode, said other of the first and second electrodes functions as an emitting electrode for emitting electrons and at the same time, said one of the first and second electrodes functions as an anode electrode for collecting, at the second portion, at least some of the electrons emitted by the other of the first and second electrodes, and wherein application of selected voltage to the first and second electrodes determines one of the first and second operating mode; and C) a gate extraction electrode, electrically coupled to the one of the first and second electrode functioning as the emitter electrode in the one of the first and second operating modes, for modulating the rate of electron emission from the emitter electrode in the one of the first and second operating modes, the gate extraction electrode being proximally disposed in an intervening region between the first and second electrodes such that reciprocal electron flow is selectably achieved within the bi-directional field emission device.

2. A bi-directional field emission device as claimed in claim 1 further including an impedance element operably coupled to the gate extraction electrode.

3. A bi-directional field emission device as claimed in claim 1 wherein the gate extraction electrode is proximally disposed on the supporting substrate in the intervening region between the first and second electrodes.

4. A bi-directional field emission device as claimed in claim 1 wherein the bi-directional field emission device is formed in a planar configuration.

5. An electron device including at least a first bi-directional field emission device and a second bi-directional field emission device, each bi-directional field emission device comprising:

A) a supporting substrate;

B) a first electrode and a second electrode, each comprising a first portion having an electron emitting tip and a second portion having a planar configuration, said first and second portions of said each of said first and second electrodes being geometrically continuously formed, said first and second electrodes selectively disposed with respect to each other on the supporting substrate, such that, the first portion of one of the first and second electrodes confronts the second portion of the other of the first and second electrodes and vice a versa, such that, in a first operating mode, said one of the first and second electrodes functions as an emitter electrode for emitting electrons from the first portion and at the same time, said other of the first and second electrodes functions as an anode electrode for collecting, at the second portion, at least some of the electrons emitted by the one of the first and second electrodes, and in a second operating mode, said other of the first and second electrodes functions as an emitting electrode for emitting electrons and at the same time, said one of the first and second electrodes functions as an anode electrode for collecting, at the second portion, at least some of the electrons emitted by the other of the first and second electrodes, and wherein application of a selected voltage to the first and second electrodes determines one of the first and second operating mode; and C) a gate extraction electrode, electrically coupled to the one of the first and second electrode functioning as the emitter electrode in the one of the first and second operating modes, for modulating the rate of electron emission from the emitter electrode in the one of the first and second operating modes, the gate extraction electrode being proximally disposed in an intervening region between the first and second electrodes such that reciprocal electron flow is selectably achieved within the bi-directional field emission device;

wherein the first bi-directional field emission device is selectively operably coupled to the second bi-directional field emission device.

6. An electronic device as claimed in claim 5 wherein the gate extraction electrode of the first bi-directional field emission device is selectively operably connected to the gate extraction electrode of the second bi-directional field emission device.

7. An electronic device as claimed in claim 5 wherein the gate extraction electrode of the first bi-directional field emission device and the gate extraction electrode of the second bi-directional field emission device are selectively, independently operably, interconnected to provide an independent group of bi-directional field emission devices.

8. An electronic device as claimed in claim 5 wherein the first electrode of the first bi-directional field emission device is operably connected to the first electrode of the second bi-directional field emission device so that both first electrodes operate in the same mode, thereby operably interconnecting the first and second bi-directional field emission devices.

* * * * *